US007541575B2

(12) United States Patent
Lock et al.

(10) Patent No.: US 7,541,575 B2
(45) Date of Patent: Jun. 2, 2009

(54) FRAGMENTING IONS IN MASS SPECTROMETRY

(75) Inventors: Christopher Mark Lock, Richmond Hill (CA); Nic Bloomfield, Newmarket (CA)

(73) Assignees: MDS Inc., Concord (CA); Applera Corporation, Framingham, MA (US)

( * ) Notice: Subject to any disclaimer, the term of this patent is extended or adjusted under 35 U.S.C. 154(b) by 335 days.

(21) Appl. No.: 11/622,064

(22) Filed: Jan. 11, 2007

(65) Prior Publication Data

US 2007/0158546 A1 Jul. 12, 2007

Related U.S. Application Data

(60) Provisional application No. 60/757,867, filed on Jan. 11, 2006.

(51) Int. Cl.
*H01J 49/02* (2006.01)
*H01J 49/26* (2006.01)

(52) U.S. Cl. ..... 250/281; 250/282

(58) Field of Classification Search ..... None
See application file for complete search history.

(56) References Cited

U.S. PATENT DOCUMENTS

| | | | |
|---|---|---|---|
| 2,959,677 | A | 11/1960 | Robinson et al. |
| 3,621,240 | A | 11/1971 | Cohen et al. |
| 3,631,436 | A | 12/1971 | Taguchi |
| 3,925,183 | A | 12/1975 | Oswin et al. |
| 4,234,791 | A | 11/1980 | Enke et al. |
| 4,311,669 | A | 1/1982 | Spangler |
| 4,551,624 | A | 11/1985 | Spangler et al. |
| 4,861,988 | A | 8/1989 | Henion et al. |
| 4,963,736 | A | 10/1990 | Douglas et al. |
| 4,987,767 | A | 1/1991 | Corrigan et al. |
| 5,248,875 | A | 9/1993 | Douglas et al. |
| 5,569,917 | A | 10/1996 | Buttrill, Jr. et al. |
| 5,639,699 | A | 6/1997 | Nakamura et al. |
| 5,679,950 | A | 10/1997 | Baba et al. |
| 5,689,111 | A | 11/1997 | Dresch et al. |
| 5,789,746 | A | 8/1998 | Kato et al. |
| 5,885,841 | A | 3/1999 | Higgs, Jr. et al. |
| 5,905,258 | A | 5/1999 | Clemmer et al. |
| 6,011,259 | A | 1/2000 | Whitehouse et al. |
| 6,015,972 | A | 1/2000 | Hager |
| 6,111,250 | A | 8/2000 | Thomson et al. |
| 6,121,607 | A | 9/2000 | Whitehouse et al. |
| RE36,906 | E | 10/2000 | Franzen et al. |

(Continued)

FOREIGN PATENT DOCUMENTS

| | | |
|---|---|---|
| EP | 567276 | 10/1993 |

(Continued)

OTHER PUBLICATIONS

Haller at al., "Collision Induced Decomposition of Peptides. Choice of Collision Parameters", J. Am. Soc. Mass Spectrom. 1996, 7, 677-681.

(Continued)

*Primary Examiner*—Jack I Berman
(74) *Attorney, Agent, or Firm*—Torys LLP

(57) ABSTRACT

Systems, methods, and computer program products useful in controlling the fragmentation of ions. Control of fragmentation is achieved by varying the collision energy imparted to precursor ions.

12 Claims, 6 Drawing Sheets

U.S. PATENT DOCUMENTS

| | | | | |
|---|---|---|---|---|
| 6,140,638 | A | 10/2000 | Tanner et al. | |
| 6,147,344 | A | 11/2000 | Annis et al. | |
| 6,177,668 | B1 | 1/2001 | Hager | |
| 6,188,066 | B1 | 2/2001 | Whitehouse et al. | |
| 6,285,027 | B1 | 9/2001 | Chernushevich et al. | |
| 6,288,394 | B1 | 9/2001 | Barnes et al. | |
| 6,380,666 | B1 | 4/2002 | Kawalo | |
| 6,451,611 | B1 | 9/2002 | Simonsen et al. | |
| 6,483,109 | B1 | 11/2002 | Reinhold et al. | |
| 6,504,148 | B1 | 1/2003 | Hager | |
| 6,512,225 | B2 | 1/2003 | Vestal et al. | |
| 6,545,268 | B1 | 4/2003 | Verentchikov et al. | |
| 6,586,727 | B2 | 7/2003 | Bateman et al. | |
| 6,621,073 | B1 | 9/2003 | Dresch | |
| 6,636,811 | B1 | 10/2003 | Walte et al. | |
| 6,657,190 | B2 | 12/2003 | Hanson et al. | |
| 6,670,606 | B2 | 12/2003 | Verentchikov et al. | |
| 6,683,301 | B2 | 1/2004 | Whitehouse et al. | |
| 6,700,117 | B2 | 3/2004 | Franzen | |
| 6,703,607 | B2 | 3/2004 | Stott et al. | |
| 6,707,033 | B2 | 3/2004 | Okumura et al. | |
| 6,720,554 | B2 | 4/2004 | Hager | |
| 6,744,043 | B2 | 6/2004 | Loboda | |
| 6,770,872 | B2 | 8/2004 | Bateman et al. | |
| 6,774,359 | B1 | 8/2004 | Hirabayahsi et al. | |
| 6,777,671 | B2 | 8/2004 | Doroshenko | |
| 6,794,640 | B2 | 9/2004 | Bateman et al. | |
| 6,797,949 | B2 | 9/2004 | Hashimoto et al. | |
| 6,835,928 | B2 | 12/2004 | Bateman | |
| 6,884,995 | B2 | 4/2005 | Bateman et al. | |
| 6,936,813 | B2 * | 8/2005 | Zavitsanos et al. | 250/282 |
| 6,946,671 | B2 | 9/2005 | Smith et al. | |
| 7,009,174 | B2 | 3/2006 | Le Blanc | |
| 7,199,361 | B2 * | 4/2007 | Bloomfield et al. | 250/282 |
| 2001/0038069 | A1 | 11/2001 | Whitehouse et al. | |
| 2001/0052569 | A1 | 12/2001 | Bateman et al. | |
| 2001/0054685 | A1 | 12/2001 | Franzen | |
| 2002/0009394 | A1 | 1/2002 | Koster | |
| 2002/0023078 | A1 | 2/2002 | Liebler et al. | |
| 2002/0070338 | A1 | 6/2002 | Loboda | |
| 2002/0125421 | A1 | 9/2002 | Yoshinari et al. | |
| 2003/0066958 | A1 | 4/2003 | Okumura et al. | |
| 2003/0122071 | A1 | 7/2003 | Plomley et al. | |
| 2003/0136905 | A1 | 7/2003 | Franzen et al. | |
| 2003/0155507 | A1 | 8/2003 | Hashimoto et al. | |
| 2003/0168589 | A1 | 9/2003 | Hager | |
| 2003/0189168 | A1 | 10/2003 | Londry et al. | |
| 2003/0189171 | A1 | 10/2003 | Londry et al. | |
| 2003/0222211 | A1 | 12/2003 | Okumura et al. | |
| 2004/0011956 | A1 | 1/2004 | Londry et al. | |
| 2004/0041090 | A1 | 3/2004 | Bloomfield et al. | |
| 2004/0123646 | A1 | 7/2004 | Echigo et al. | |
| 2004/0126277 | A1 | 7/2004 | Yamamoto | |
| 2004/0132083 | A1 | 7/2004 | Kawato et al. | |
| 2004/0164240 | A1 | 8/2004 | Okumura et al. | |
| 2004/0195503 | A1 | 10/2004 | Kim et al. | |
| 2004/0251409 | A1 | 12/2004 | Le Blanc | |
| 2005/0118724 | A1 | 6/2005 | Bateman et al. | |
| 2005/0247872 | A1 | 11/2005 | Loboda et al. | |
| 2005/0277789 | A1 | 12/2005 | Bloomfield et al. | |
| 2006/0219892 | A1 | 10/2006 | Walte et al. | |

FOREIGN PATENT DOCUMENTS

| | | |
|---|---|---|
| EP | 0887646 | 12/1998 |
| EP | 1006559 | 6/2000 |
| WO | WO 99/38193 | 7/1999 |
| WO | WO 00/33350 | 6/2000 |
| WO | WO 03/094197 | 11/2003 |
| WO | WO 2004/090933 | 10/2004 |
| WO | WO 2007079589 A1 * | 7/2007 |

OTHER PUBLICATIONS

Marshall et al., "Fourier Transform Ion Cyclotron Resonance Mass Spectrometry: A Primer". Mass Spectrometry Reviews, 1998, 17, 1-35.

Dawson, P.H., "Ion Optical Properties of Quadrupole Mass Filters". Advances in Electronics and Electron Physics, 1980, 53, 153-208.

Chernuschevich et al., "An introduction to quadrupole—time-of-flight mass spectrometry", Journal of Mass Spectrometry, 2001, 36, 849-865.

Frank, "Mass spectrometry with cryogenic detectors", Nuclear Instruments & Methods in Physics Research, Apr. 2000, 444, 375-384, North-Holland Publishing Company, Amsterdam, NL.

Jordanov et al., "Compact circuit for pulse risetime discrimination", Nuclear Instruments & Methods in Physics Research, Oct. 1996, 380, 353-357, North-Holland Publishing Company, Amsterdam, NL.

Kohli et al., "An alternative sampling algorithm for use in liquid chromatography/tandem mass spectrometry experiments", Rapid Commun. Mass Spectrom, 2005, 19, 589-596.

Printouts from www.mdsciex.com, accessed Nov. 16, 2004.

Jonscher et al., "The Whys and Wherefores of Quadrupole Ion Trap Mass Spectrometry", www.abrf.org, accessed Nov. 17, 2004.

Gerlich, RF Ion Guides, The Encyclopedia of Mass spectrometry, 2003, 1, 182-194.

Printouts from www.genomicglossaries.com, accessed Feb. 2, 2004.

Chernushevich et al., "Orthogonal-1", Analytical Chemistry News & Features, Jul. 1, 1999, 452-461.

Wada et al., "Development of an RF Ion guide for trapping energetic radioactive nuclear ions", AIP Conference Proceedings, 606, 1.

Printouts from http://huygensgcms.gsfc.nasa.gov, accessed Feb. 3, 2004.

Okumura et al., "Orthogonal Trap-TOF Mass Spectrometer (1)—Synchronous Coupling of Trap and TOF", Proceedings of the 51st ASMS Conference on Mass Spectrometry and Allied Topics, Jun. 8-12, 2003, Montreal, Quebec, Canada.

Yu et al., "A Novel LC/MS Background Substraction Technique for the Detection of Drug Metabolites in Biological Samples", Merck Research Laboratories.

Windig et al., "A Noise and Background Reduction Method for Component Detection in Liquid Cromatography/Mass Spectrometry", Anal. Chem., 1996, 68, 3602-3606.

Covey et al., "High-Speed Liquid Chromatography/Tandem Mass Spctrometry for the Determination of Drugs in Biological Samples", Anal. Chem., 1986, 58, 2453-2460.

Thermo Finnigan LLC, Data Dependent ExperimentTM tool.

Waters Corporation, Data Directed Analysis Tool.

* cited by examiner

Dynamic Collision Energy

- Dynamic Adjustment of CE is the answer.

FRAGMENTING IONS IN MASS SPECTROMETRY

CROSS-REFERENCE TO RELATED APPLICATIONS

This application claims the benefit of U.S. provisional patent application 60/757,867, entitled Fragmenting Ions in Mass Spectrometry and filed 11 Jan. 2006, the entire contents of which are incorporated herein by this reference.

BACKGROUND

The invention relates to mass spectrometers, and more particularly to mass spectrometers which modulate sample collision energy.

Mass spectrometry techniques can involve the detection of ions that have undergone physical changes in a mass spectrometer. Frequently, the physical change involves fragmenting a selected precursor (or "parent") ion and recording the mass spectrum of the resultant fragment ions. The information in the fragment ion mass spectrum is often a useful aid in elucidating the structure of the precursor ion. The general approach used to obtain a mass spectrometry/mass spectrometry (MS/MS or $MS^2$) spectrum is to isolate a selected precursor ion with a suitable mass-charge (m/z) analyzer, and to subject the precursor ion to energetic collisions with a neutral gas in order to analyze the mass of the resulting fragment ions in order to generate a mass spectrum.

Triple quadrupole mass spectrometers (TQMSs) perform MS/MS analyses through the use of two quadrupole mass analyzers separated by a pressurized reaction region, sometimes called a collision cell, for the fragmentation step. For a sample mixture, the first quadrupole mass analyzer selectively transmits ions of interest, or precursor ions, into a collision cell containing an inert background gas. Fragments are produced through collision-induced dissociation (CID) upon collision with the neutral gas atoms or molecules. The fragments are then transmitted and mass-analyzed in a third quadrupole mass analyzer. Chemical information, including the structure of the precursor ion, can be derived from these fragments.

Quadrupole-time of flight (QqTOF) mass spectrometers typically employ time-of-flight (TOF) mass analyzers in place of the third quadrupole sets used in TQMS systems. Use of TOF analyzers in MS/MS techniques provides improved capabilities where wide-range, rapidly repeated scans are desired. TOF analyzers can enable, for example, full scan data to be acquired over a wide range of m/z ratios, each scan being completed in sub-millisecond time frames. This is particularly advantageous in that thousands of scans may be desired in accumulating a single mass spectrum.

The nature of fragmentation within a collision cell of a precursor ion selected from a mass analyzer is dependent upon the collision energy (CE) experienced by the precursor ion within the collision cell. The CE (which is sometimes also referred to as the fragmentation energy) is a function of factors which include the momentum, or injection energy, that the ion possesses upon entering the collision cell, and/or which is imparted to the ion while it is within the collision cell, and the pressure of any gas(ses) provided within the collision cell.

In order to obtain more information from a precursor ion, an additional stage of MS can be applied to the MS/MS schemes outlined above, resulting in MS/MS/MS, or $MS^3$. For example, the collision cell may be operated as an ion trap, wherein fragment ions are resonantly excited to promote further CID. See, for example, WO 00/33350, published 8 Jun. 2000 in the name of Douglas et al. In that case, the third quadrupole of a TQMS device functions as a mass analyzer to record the resulting fragmentation spectrum.

In $MS^2$ and $MS^3$ techniques, the optimal collision energy may be selected based on the charge state and mass of the precursor ion. See, for example, Haller et al., J. Am. Soc. Mass Spectrom. 1996, 7, 677-681, the entire contents of which are incorporated by this reference. Although this information is theoretically known, however, in practice it can be difficult to approximate the optimum collision energy, and several attempts are often necessary to produce a useful spectrum, at the expense of time and samples. For example, the use of a non-optimal collision energy can result in over- or under-fragmentation of the precursor ion and significant reduction in the quantity and quality of the structural information available. The retention of the precursor ion in the resultant spectrum can be useful for providing a reference ion for determining the extent of fragmentation.

An alternative approach to obtaining improved ion fragmentation spectra is described in US 2004/0041090, published 4 Mar. 2004 in the name of Bloomfield, et al.

SUMMARY

Generally speaking, the invention relates to systems, methods, and computer program products useful in controlling the fragmentation of ions. Such controlling is useful, for example, in obtaining mass spectra having targeted distributions of daughter ions and residual precursor ions. Control of fragmentation is achieved by varying the collision energy imparted to precursor ions, most preferably in real time, in accordance with the disclosure herein. The distribution of fragment ions tracked in real time pertains to the collision (or fragmentation) energy currently in use.

According to one aspect of the invention, improved ion fragmentation is obtained by:

(i) at a starting collision energy provided within a mass spectrometer, fragmenting at least one of a plurality of precursor ions generated from a sample to produce a plurality of daughter ion fragments;

(ii) determining a total ion current associated with unfragmented precursor ions in the mass spectrometer;

(iii) determining an ion current associated with the daughter ion fragments in the mass spectrometer;

(iv) determining the ratio of the current associated with the unfragmented precursor ions to the current associated with the daughter ion fragments;

(v) adjusting the collision energy provided in the mass spectrometer at (i) to move the ratio toward a value within a predetermined range; and (vi) repeating (i)-(v), as necessary, to bring the ratio value into the predetermined range.

An optimal collision energy may be determined in a variety of ways. One suitable manner is based on the charge state and mass of the precursor ion, as described, for example, in Haller et al., J. Am. Soc. Mass Spectrom. 1996, 7, 677-681.

As will be understood by those skilled in the relevant arts, the collision energy imparted to the ions may be imparted and adjusted in a variety of ways, many of which are known and others of which will doubtless hereafter be developed. For example, the momentum of the ions upon entry to the collision cell may be adjusted, as for example by adjusting the relative voltages of various components of the mass spectrometer, and/or by adjusting the relative pressures of gasses inside the components, as described herein. In addition, the ions may be excited within the mass spectrometer, as for example by exciting them in radial and/or axial directions using radio-frequency (AC), radio frequency (RF), and/or steady state (direct current or DC) excitation within a quadrupole or other ion guide or ion trap. Any method of adjusting the energy imparted to ions within the mass spectrometer, and thereby controlling the fragmentation of ions, consistent with the disclosure herein is suitable for implementing the invention.

The processes described herein are preferably carried out in automated fashion, through the implementation and use of suitable devices, such as automated control systems operated using suitable computer programming. When automated processes are employed, the analyst may be freed, for example, from any requirement for intervening. The analyst may be enabled, moreover, either at the inception or during an analysis process, to provide suitable inputs, such as initial starting conditions, which could include, for example, a starting collision or fragmentation energy (CE) and a change in collision energy to be applied in any interaction. Such a change could be constant, for example, or could vary as a function of, for example, a determined difference between the energy applied in the present iteration and the desired fragmentation or collision energy value.

Suitable starting energies may also be determined, for example, using charge state and the mass of the precursor ion, as described, for example, in Haller et al., J. Am. Soc. Mass Spectrom. 1996, 7, 677-681.

Implementation of the invention using an automated mass analyzer in conjunction with suitable computer control programs as described herein, is expected to enable optimal collision or fragmentation energies to be obtained, to within one electron volt (1 eV), within seven or fewer iterations. Suitable collision energies will often be obtained within as few as two iterations.

In other aspects the invention provides apparatus and computer program products adapted for use in implementing such processes.

BRIEF DESCRIPTION OF THE FIGURES

The invention is illustrated in the figures of the accompanying drawings which are meant to be exemplary and not limiting, in which like references are intended to refer to like or corresponding parts, and in which.

DETAILED DESCRIPTION OF THE ILLUSTRATIVE EMBODIMENTS

Figure 1:
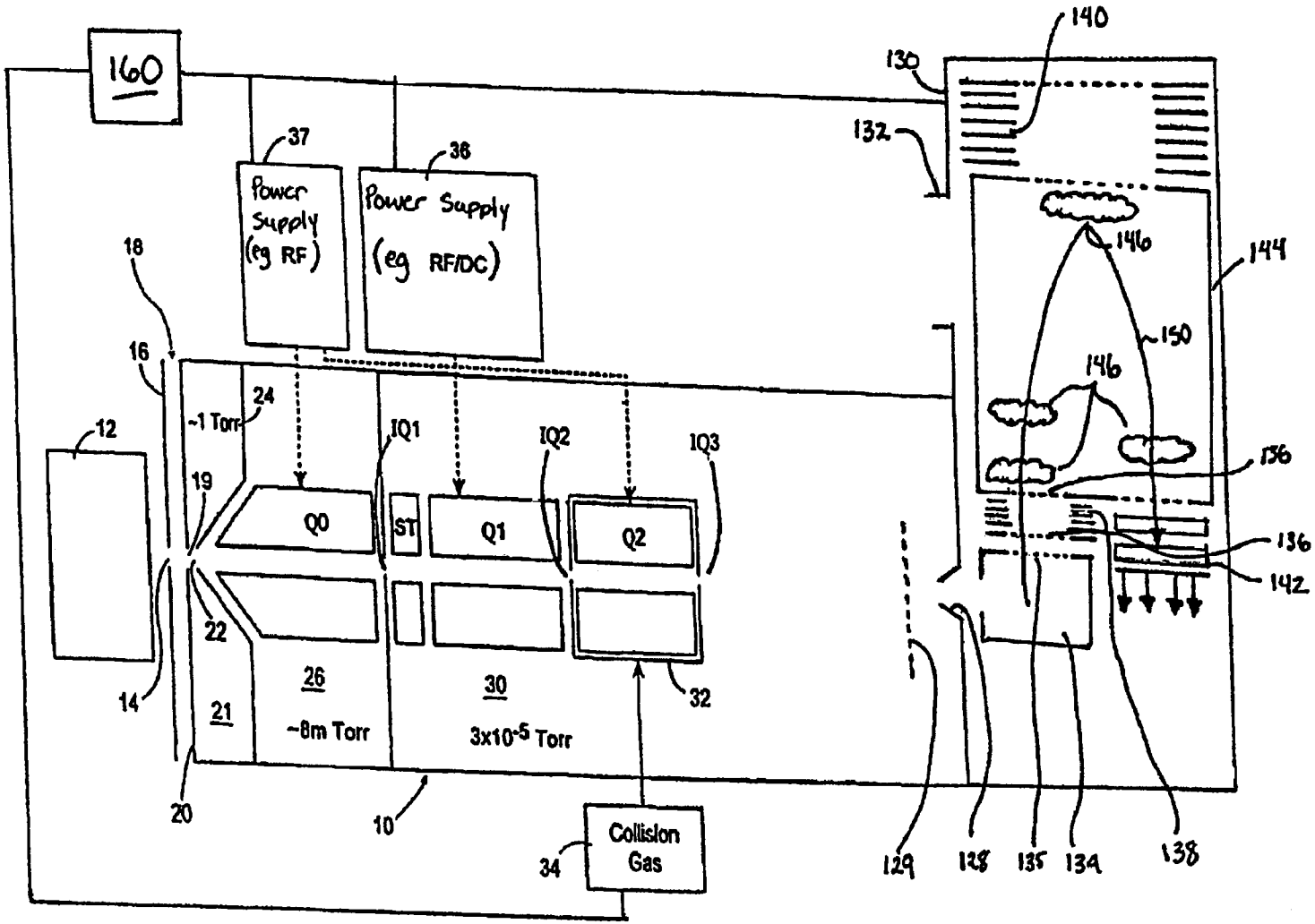
FIGS. 1 and 2 are system block diagrams of mass spectrometers suitable for use implementing the invention.
Figure 2:
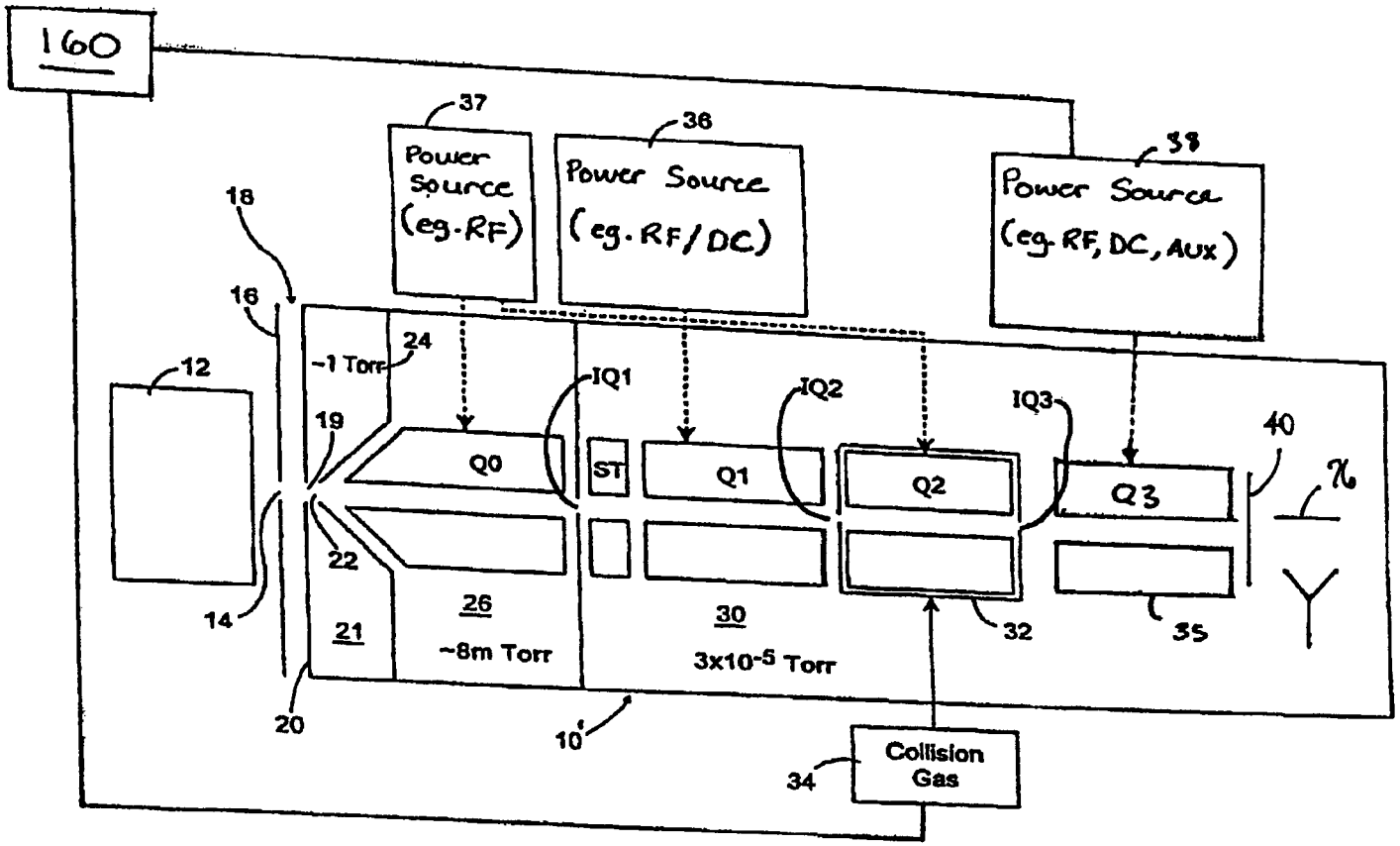

FIGS. 1 and 2 are system block diagrams of mass spectrometers 10, 10' suitable for use implementing the invention. Mass spectrometers 10, 10' shown in FIGS. 1 and 2 comprise TQMS and QqTOF configurations. However, as will be understood by those of ordinary skill in the relevant arts, a wide variety of mass spectrometer configurations suitable for use in implementing the invention are now available, and will doubtless hereafter be developed. For example, in addition to quadrupole- and TOF-based devices, devices using ion traps and Fourier transform devices, suitably adapted, are also suitable for use in implementing the invention. In particular, but without limiting the scope of the invention, it is noted that any type of tandem or recursive (e.g., $MS^n$) mass spectrometer is suitable for use in implementing the invention.

Each of mass spectrometers 10, 10' shown in FIGS. 1 and 2 comprises an ion source 12, which may include, for example, an electrospray, ion spray, or corona discharge device, or any other known or subsequently-developed source suitable for use in implementing the invention described herein. Ions from source 12 may be directed through aperture 14 in aperture plate 16 and into a curtain gas chamber 18. Curtain gas chamber 18 may be supplied with curtain gas such as argon, nitrogen, or other, preferably inert, gas from a gas source (not shown). Suitable methods for introduction and employment of curtain gas and curtain gas chamber 18 are disclosed, for example, in U.S. Pat. No. 4,891,988 to Cornell Research Foundation, Inc., the contents of which are incorporated herein by this reference.

Ions may be passed from curtain gas chamber 18 through orifice 19 in orifice plate 20 into differentially-pumped vacuum chamber 21. As will be understood by those of ordinary skill in the relevant arts, the use of curtain gas chamber 18 and differential gas pressures within chambers 18, 21 may be used to cause desired sets of ions emitted by source 12 to move through mass spectrometer 10' in a desired manner. Such ions may then be passed through aperture 22 in skimmer plate 24 into a second differentially-pumped vacuum chamber 26. Typically, in traditionally-implemented systems, the pressure in chamber 21 is maintained at the order of 1 or 2 Torr, while the pressure in chamber 26, which is often described as the first chamber of the mass spectrometer proper, is evacuated to a pressure of about 7 or 8 mTorr.

In chamber 26, there may be provided a multipole ion guide Q0 which may comprise, for example, a conventional RF-only guide. A number of new varieties of ion guides are now being provided, some or all of which may, as will be understood by those of ordinary skill in the relevant arts, once they have been made familiar with this disclosure, be suitable for use in implementing the invention disclosed herein. Ion guide Q0 may serve, for example, to cool and focus the stream of ions present within the mass spectrometer, and may be assisted in such functions by the relatively high gas pressures present within chamber 26. Chamber 26 also serves to provide an interface between ion source 12, which may typically operate at atmospheric pressures, and the lower-pressure vacuum chambers 21, 26, thereby serving to control gas received from the ion stream, prior to further processing.

In the embodiments shown in FIGS. 1 and 2, an interquad aperture IQ1 provides for ion flow from chamber 26 into a second main vacuum chamber 30. In second chamber 30, there may be provided RF-only rods (labeled ST, for "stubbies", to indicate rods of short axial extent), which can serve as Brubaker lenses. Quadrupole rod set Q1 may also be provided in vacuum chamber 30, which may be evacuated to approximately 1 to $3\times10^{-5}$ Torr. Chamber 30 may also be provided with a second quadrupole rod set Q2 in a collision cell 32, which may be supplied with collision gas at 34, and may be designed to provide an axial field biased toward the exit end as taught for example by Thomson and Jolliffe in U.S. Pat. No. 6,111,250, the entire contents of which are incorporated herein by reference. Cell 32 may be provided within the chamber 30 and may include interquad apertures IQ2, IQ3 at either end. In traditionally-implemented systems, cell 32 is typically maintained at a pressure in the range $5\times10^{-4}$ to $8\times10^{-3}$ Torr, and more preferably at a pressure of about $5\times10^{-3}$ Torr.

In the embodiment shown in FIG. 1, mass spectrometer 10 comprises lens 129 and TOF mass analyzer 130. As will be understood by those of ordinary skill in the art, a variety of TOF mass analyzer configurations are know available, and will doubtless hereafter be developed. As noted previously, any mass analyzers and other devices suitable for the purposes disclosed herein are suitable for implementing the invention.

In the embodiment shown in FIG. 1, as ions leave chamber 30, they are passed through a focusing grid 129 and aperture 128 into ion storage zone 134 of analyzer 130. As will be understood by those of ordinary skill in the relevant arts, ions may be collected in storage zone 134 and passed through window 135 and into main chamber or flight tube 144 by use of electrical pulses applied at grids 135 and accelerating column 138. Ion mirror 140 may be provided at the distal end of TOF analyzer 130, and detector 142 as shown.

Under the influence of electrical fields provided at grids 136 and accelerating column 138, ion clouds 146 may be accelerated toward ion mirror 140 and then into detector 142, as indicated by arrow 150. As will be understood by those skilled in the relevant arts, mass-charge (m/z) ratios of ions in clouds 146 may be determined by suitable timing and analysis electrical fields applied at 136, 138, and 146.

In the embodiment shown in FIG. 2, which represents a TQMS analyzer 10', ions pass into a third quadrupole rod set Q3, indicated at 35, and an exit lens 40 as they leave chamber 32. Pressure in the Q3 region may be the same as that for Q1, namely 1 to $3\times10^{-5}$ Torr. A detector 76 is provided for detecting ions exiting through the exit lens 40.

In the embodiments shown in FIGS. 1 and 2, mass spectrometers 10, 10' comprise controller 160. Controller 160 may be adapted for receiving, storing, and otherwise processing data signals acquired or otherwise provided by mass spectrometer 10, 10' and associated devices, and for adjusting and/or otherwise controlling the collision energy imparted to ions within mass spectrometers 10, 10' as disclosed herein. Controller 160 may further provide a user interface suitable for controlling MS systems 10, 10', including for example input/output devices suitable for accepting from user(s) of the systems and implementing system commands, such as keyboards, pointing and control devices such as mice and trackballs, and displays such as cathode ray tubes, or liquid crystal diode- (LCD-), or light-emitting diode- (LED-) based screens. In particular, controller 160 may be adapted for processing data acquired by detectors 142, 76, and providing to mass spectrometers 10, 10' command signals determined at least in part by the processing of such data.

As will be understood by those skilled in the relevant arts, controller 160 can comprise any data-acquisition and processing system(s) or device(s) suitable for accomplishing the purposes described herein. Controller 160 can comprise, for example, a suitably-programmed or -programmable general- or special-purpose computer, or other automatic data processing devices. Controller 160 can be adapted, for example, for controlling and monitoring ion detection scans conducted by mass spectrometers 10, 10'; for acquiring and processing data representing such detections by mass spectrometers 10, 10' of ions by provided source 13 and collision chamber 32, as described herein; and for controlling the various RF, DC, and AC voltages imparted to the various components of spectrometers 10, 10' and the gas pressures within the various sections of spectrometers 10, 10'.

Accordingly, controller 160 can comprise one or more automatic data processing chips adapted for automatic and/or interactive control by appropriately-coded structured programming, including one or more application and operating systems, and by any necessary or desirable volatile or persistent storage media, as well as any suitable associated hardware such as switches, relays, and device controllers. As will be understood by those of ordinary skill in the relevant arts, once they have been made familiar with this disclosure, a wide variety of processors and programming languages suitable for implementing the invention are now available commercially, and will doubtless hereafter be developed. Examples of suitable controllers, comprising suitable processors and programming, are those incorporated in the API 3000™ or API400™ MS systems available through MDS Sciex of Ontario, Canada.

Power supplies 37, 36, and 38, for providing various RF and DC voltages and auxiliary AC to the various quadrupoles are provided, and may be operated under the control of controller 160. For example, Q0 may be operated as an RF-only multipole ion guide Q0 whose function is to cool and focus the ions, as taught for example in U.S. Pat. No. 4,963,736, the contents of which are incorporated herein by reference. As a further example, Q1 can be employed as a resolving quadrupole using RF/DC fields and voltages. The RF and/or DC voltages provided by power supplies 37, 36 may be chosen by or with the use of controller 160 to transmit only precursor ions of interest, or ions of desired ranges of m/z, into Q2. Precursor ions of interest and/or desired m/z ranges may be determined using any suitable means. For example, a human user knowing one or more such values may input them to controller 160 using suitably adapted input/output devices, including control system software, for interpretation, storage, and/or other processing by controller 160.

Moreover, collision cell Q2 (32) may be supplied with collision gas from source 34 to dissociate or fragment precursor ions to produce 1 st or subsequent generations of daughter fragment ions. DC voltages may also be applied (using one or more of the aforementioned power sources or a different source) on the plates IQ1, IQ2, IQ3 and the exit lens 40. The output of power supplies 36, 37 and/or 38, and/or the RF and/or DC voltage(s) applied to the plates at IQ1, IQ2, IQ3, may be varied, manually or under the control of controller 160, in order to vary the injection energy of the precursor ions as they enter Q2, as discussed in greater detail below. In the embodiment shown in FIG. 2, Q3 may be operated as a linear ion trap to trap and scan ions out of Q3 in a mass dependent manner using axial ejection techniques.

As noted previously, any one or more of power supplies 36, 37, 38: voltages at electrodes of devices Q0, ST, Q1, Q2, Q3 and at IQ1, IQ2, and IQ3; curtain gas pressures provided at 18, and pressures provided at chambers 21, 26, 30, and 32, as well as any one or more components of mass analyzers 130, 76 may be controlled by controller 160, as described herein, in order to control the energy and movement of precursor and fragment ions at any one or more stages of mass spectrometers 10, 10', including with collision cell Q2 (32).

In the embodiments illustrated in FIGS. 1 and 2, ions from ion source 12 may be directed into vacuum chamber 30 where, if desired, a precursor ion m/z (or range of mass-to-charge ratios) may be selected by Q1 through manipulation of the RF and/or DC voltages applied to the quadrupole rod set as well known in the art. Following precursor ion selection, the precursor ions may be accelerated into Q2 by a suitably-selected voltage drop (or rise) between Q1 and IQ2, thereby injecting the precursor ions at with a desired injection energy and inducing fragmentation as taught for example by U.S. Pat. No. 5,248,875, the contents of which are hereby incorporated by reference. For example, in suitably adapted devices such as the API 3000™ or API400™ MS systems available through MDS Sciex of Ontario, Canada, a DC voltage drop of approximately 0 to 150 volts may be provided between Q1 and IQ2, depending on the desired injection energy.

The degree of fragmentation of ions in collision cell 32 can be controlled in part by the pressure in the collision cell and/or quadrupole Q2, and the voltage difference between Q1 and IQ2. In the preferred embodiment, pressures within the various components of mass spectrometer 10, 10' and the DC voltage difference between Q1 and IQ2 is varied by controller 160 automatically, or in response to command inputs from a user of the system 10, 10', in order to vary the injection energy applied to the precursor ions. Alternatively, voltages and pressures between Q1 and Q2, IQ1 and IQ2, IQ1 and Q1, Q0 and IQ1 may be varied by controller 160 and/or the user to vary the injection energy applied to the precursor ions. Similarly, a tapered rod set can be employed to vary the injection energy, depending on the degree of taper. Other means are also possible for varying the voltage applied to the ion stream as it is injected into the collision cell, as for example by exciting the ions in radial and/or axial directions within the collision cell 32.

Figure 3:
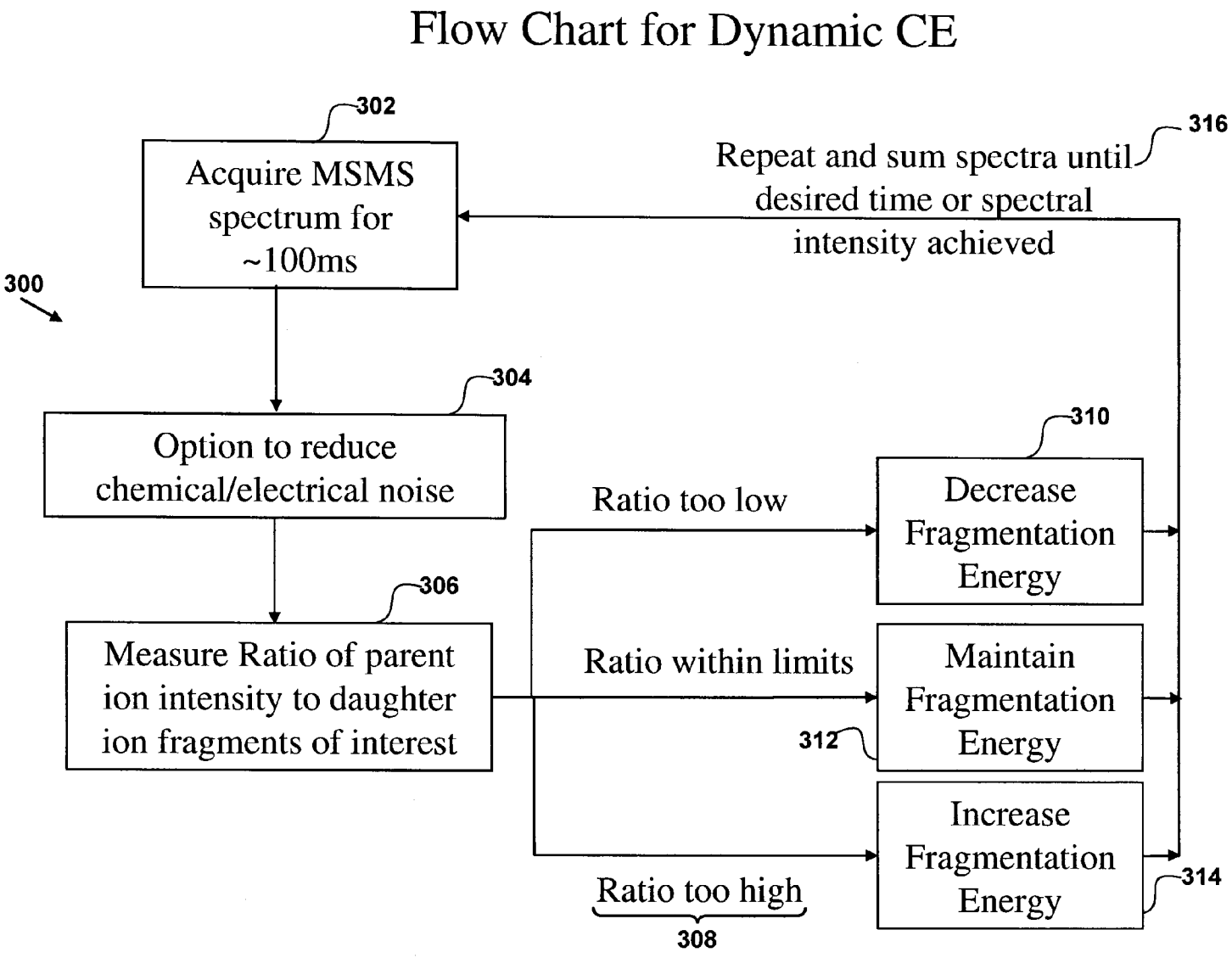
FIG. 3 is a flow chart illustrating a method of obtaining improved ion fragmentation and/or identifying an optimal collision or fragmentation energy in accordance with the invention.

General steps of operation of a mass spectrometer in accordance with an embodiment of the invention are illustrated in FIG. 3. Process 300 shown in FIG. 3 is suitable for implementation by a mass spectrometer such as either of spectrometers 10, 10', under the fully- or partly-automatic control of controller 160, and/or any of the other mass spectrometers compatible with the purposes disclosed herein. Process 300 is adapted for acquiring an MS/MS spectrum for a given CE for a given length of time, e.g. 100 ms.

At 302 an MS-MS spectrum is acquired over a desired period of time, for example 100 ms. The MS-MS spectrum may be obtained by subjecting a desired set of precursor ions to collision conditions to produce a target set of daughter ions. For example, a set of such precursor ions may be subjected to a desired set of circumstances, including a desired predetermined CE, in a collision cell Q2 (32). A spectrum representing the ion currents of any residual precursor ions and the daughter ions so produced may be obtained.

At 304, if desired, chemical/electrical is processed out of the signals used to generate the spectrum according to any suitable technique(s). A number of suitable techniques are now available, and doubtless others will hereafter be developed.

At 306 the ratio (the "ion current ratio") of the parent ion current intensity to that of those daughter ion fragments of interest resulting from collision at the previously-set CE is determined, using any methods compatible with the purposes disclosed herein.

At 308 a determination is made as to whether the ion current ratio for the ions produced and scanned at 302 is too high, too low, or within a desired range of limits.

If the ion current ratio is too low, at 310 the CE can be decreased, as for example by reducing the relative voltage induced between Q1 and IQ2 and/or the relative gas pressure within collision chamber 32.

If the ratio is too high, at 314 the CE can increase. If the ratio is within the desired or otherwise acceptable limit, then the CE can be maintained at the current value.

At 316 a determination can be made as to whether the desired ion current and/or a desired spectral intensity has been obtained. If the desired result has been obtained, the process 300 can be halted; else the process can be repeated until the result has been obtained.

Figure 4:
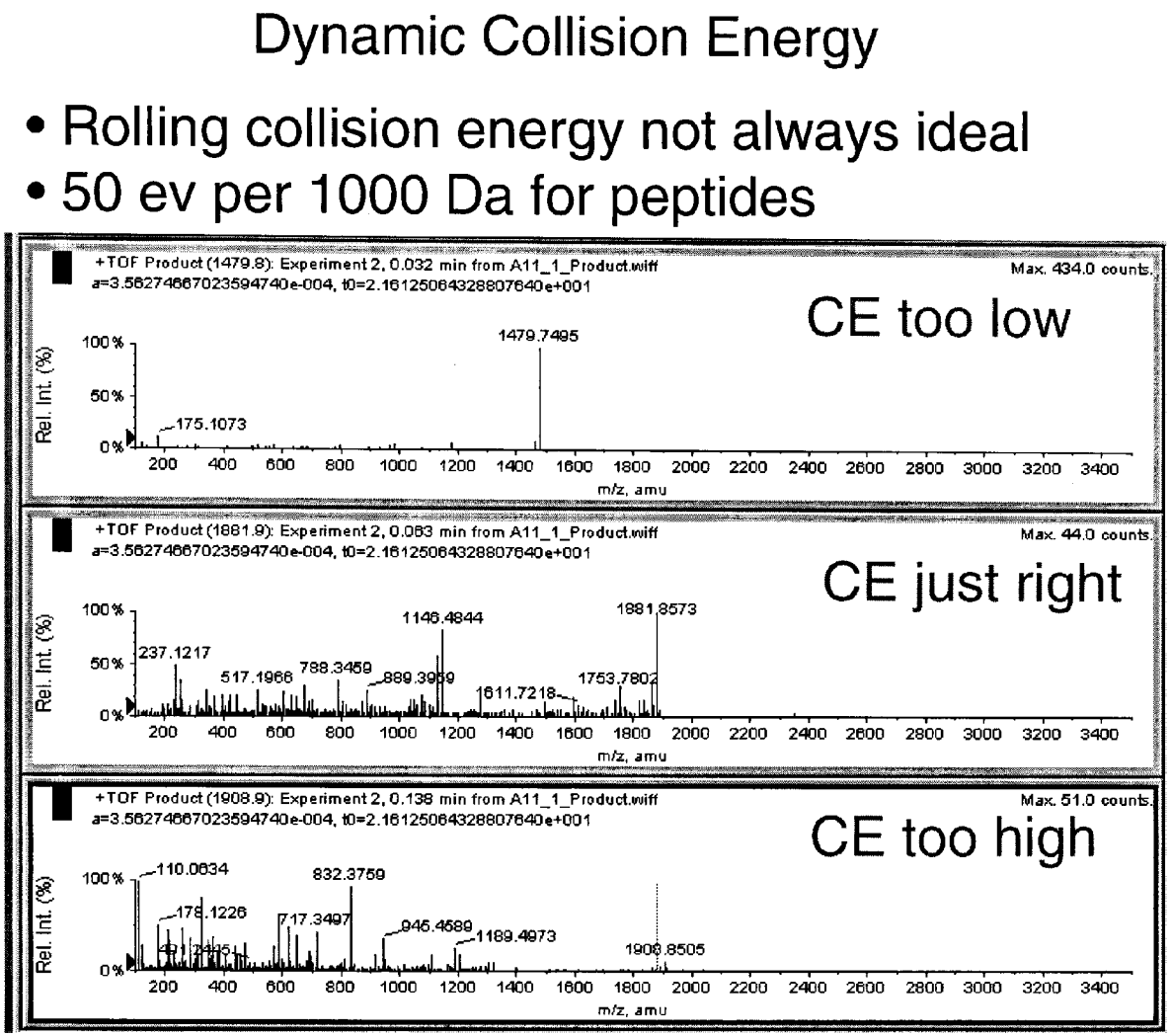
FIG. 4 is a spectral plot showing a fragmentation pattern for three different peptides derived from the protein Bovine Serum Albumin obtained with collision energies of (A) 74 eV, (b) 94 eV, and (c) 95.5 eV, respectively.

The results obtained in a first series of experiments are shown in FIG. 4. While the process described enables an appropriate fragmentation efficiency to be chosen without defining any initial relationship between fragmentation energy and mass, often the nature of the sample provides a clue to a good starting point. Here the peptide nature of the sample and the single charge state suggest a well-utilized approximate relationship between mass and CE of ~50 eV/1000 Da.

Such empirically-derived relationships are known for other charge states of peptides and for other non-peptide compounds. (See, e.g., Haller et al., J. Am. Soc. Mass Spectrom. 1996, 7, 677-681.) However, the relationships are only loose approximations and are a guideline rather than a rule, since structural variability in ions of identical mass even within the same compound class can have significant impact on fragmentation. The processes described herein, implemented in conjunction with suitably-configured computer programming, can be used to determine such ratios empirically.

Where a single analysis requires multiple MS/MS of a variety of different compound classes, it may not be possible to derive such an equation to provide the optimum fragmentation efficiency. The method described herein enables a system 10, 10' to rapidly and preferably automatically arrive at an optimum efficiency by optimizing MS/MS spectra independently based on actual rather than theoretical fragmentation patterns. Even if initial starting fragmentation conditions chosen are far removed from the ideal, the iterative feedback will move the conditions rapidly to an optimal point.

The CE may be changed at each iteration by any suitable fraction of its current value, for example by changing the CE 10% from the value of the previous iteration. In many circumstances, it is preferable to avoid large variations, as the chance to overshoot the optimal value can be significant. Similarly, in many conditions small variations can greatly increase the number of iterations required. As will be immediately apparent to those skilled in the relevant arts, it is also possible to have a dynamically-controlled CE variation step, so that the relative change in CE is determined by factors such as the quality of the spectra and/or the ion current ratio at a presently-performed iteration. Such processes are well suited for implementation using suitably-configured automatic data processing devices, operating appropriately-configured computer programs, within controllers 160.

In some conditions, it may be advantageous to calculate the magnitude of the collision energy change at each iteration relative to the closeness of the ratio of parent to fragment ions to that targeted, Such that for example a CE that is far removed from ideal can result in a larger change than one that is closer to ideal. Thus the change in CE at each iteration can be decreased as the CE value approaches optimal. While this approach is the most efficient envisage to achieve optimal fragmentation conditions, several other methods are available, which may be advantageous in certain conditions.

For example, the relative change in intensity of daughter or precursor ions with collision energy may be used to predict the desired collision energy. Additionally, in the case when the precursor ion is automatically selected in an MS scan, the intensity of the precursor ion in the MS spectrum can be used to set the target ion intensity for the precursor ion in the MS/MS acquisition as opposed to the ratio of the precursor to the fragment ions.

An example of a relationship suitable for use in determining a desired change in collision or fragmentation energy is:

$$\Delta CE = m * ln(\text{measured ratio}) + B,$$

where, as will be understood by those of ordinary skill in the relevant arts, once they have been made familiar with this disclosure, m and B are constants derived through experimentation.

FIG. 4 is a spectral plot showing the fragmentation pattern of three different peptides derived from the protein Bovine Serum Albumin obtained with discrete CE values equal to: (A) 74 eV, (B) 94 eV, and (C) 95.5 eV, respectively. Data used in preparing the plots were obtained without iterating CE according to the invention.

Figure 5:
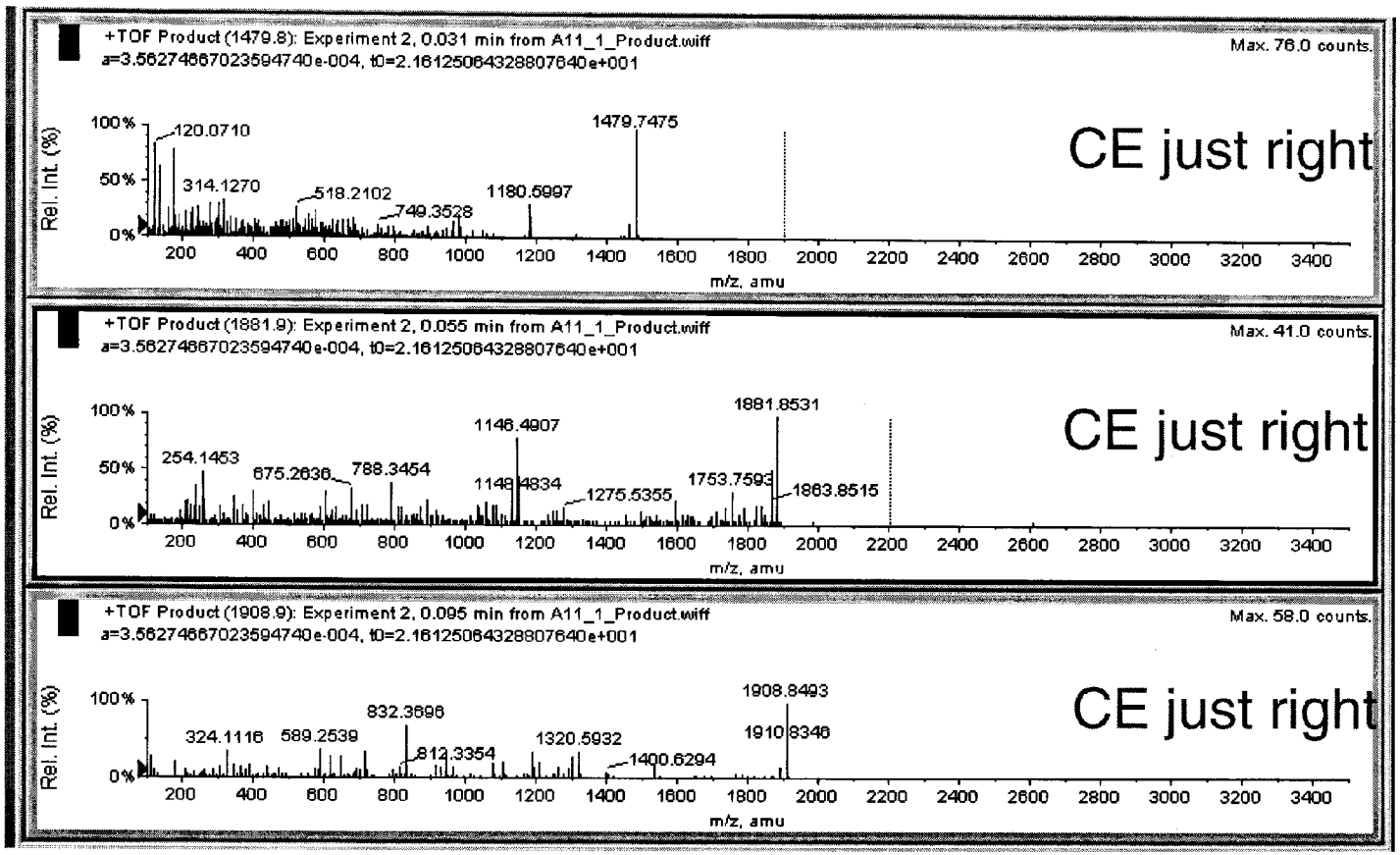
FIG. 5 is a spectral plot showing a final fragmentation pattern for the peptides analyzed in FIG. 4, obtained through analysis in accordance with the invention.

FIG. 5 is a spectral plot showing a final fragmentation pattern for the peptides analyzed in FIG. 4, obtained through analysis in accordance with the invention. The spectral plots of FIG. 5 were obtained through analysis using the same initial collision energies applied in the analysis depicted in FIG. 4. However, the collision was then automatically incremented, decremented, or left unchanged based on a calculated fragmentation efficiency and according a targeted parent/fragment ion distribution in accordance with the invention. The spectra shown in FIG. 5 may be interpreted as a sum of the fragmentation spectra obtained at multiple collision energy levels. In the specific examples shown, the collision energy was (a) increased, (b) left unchanged, and (c) decreased.

The accumulation time of each individual scan in the example shown in FIG. 5 was 250 ms, with multiple scans being summed to generate each spectrum shown. Each scan consisted of two Q2 RF steps of 80 amu and 280 amu. Calculation of the fragmentation efficiency was not made until the first scan was complete and additionally a statistically valid number of ions were present in the MS/MS spectrum such that the spectrum was wholly representative of the current fragmentation conditions. Upon attaining these conditions the ratio of parent ion count to fragment daughter ions was determined algorithmically. In this example a fixed collision energy adjustment at each iteration was made as opposed to the more efficient proportional adjustment described above. If the parent ion to daughter ion ratio was high the collision energy was increased by 15% if the value was low it was decreased by 15% is the value fell within the chosen acceptance criteria the value remained unchanged.

It is advantageous in some circumstances that scans be acquired at the fastest speed available to enable rapid adjustment of the collision energy to the optimum. It can be advantageous in such and other circumstances that the decision to change fragmentation energy be based on all the ion events recorded by the detector and not just the mass range of interest to the user.

For the purpose of the examples described herein, each spectrum was accumulated until a given number of total fragment ions were recorded or ~2 sec of accumulation time was reached.

Figure 6:
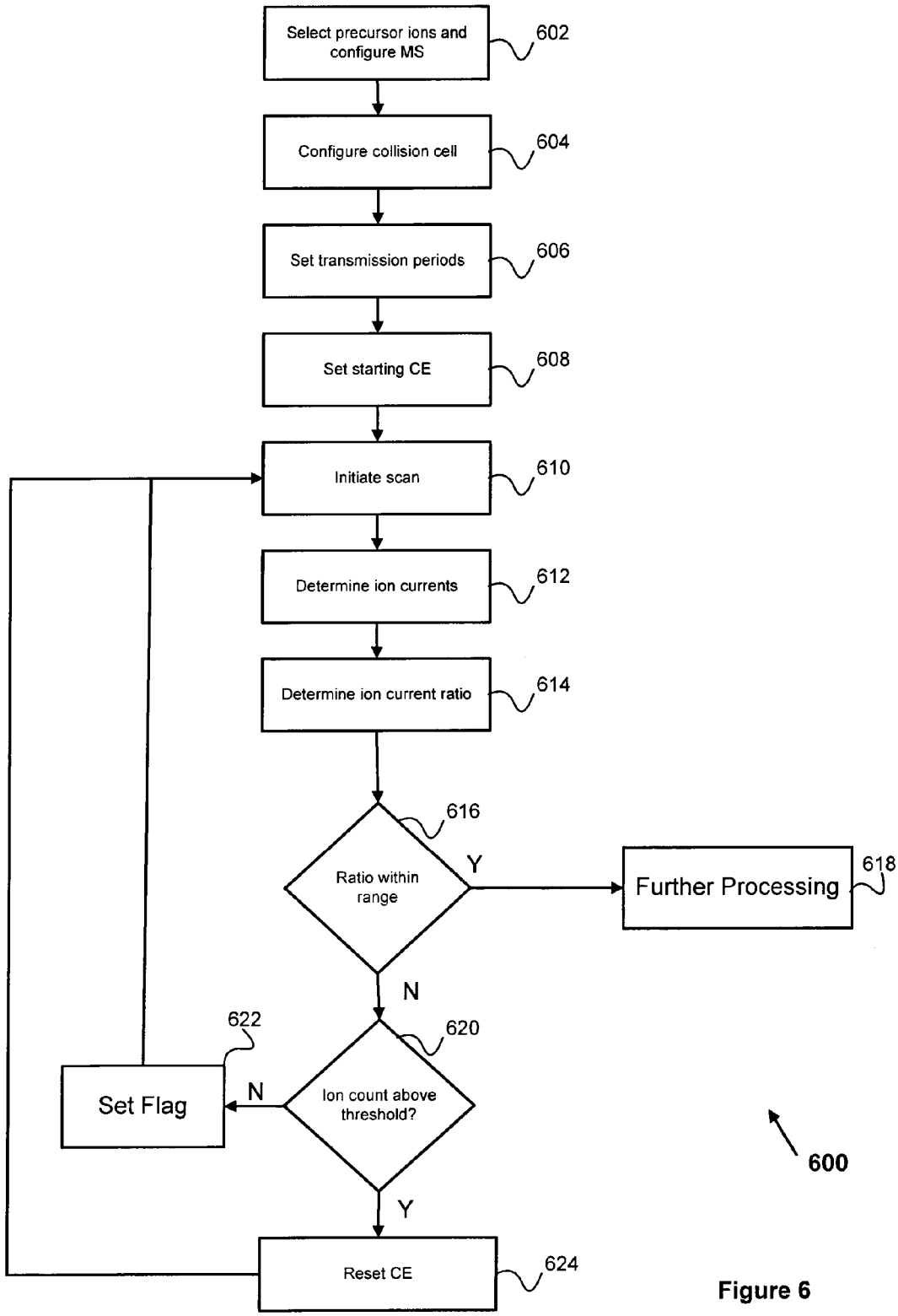
FIG. 6 is a flow chart illustrating a method of obtaining improved ion fragmentation and/or identifying an optimal collision or fragmentation energy in accordance with the invention.

FIG. 6 is a flow chart illustrating a method of obtaining improved ion fragmentation and/or identifying an optimal collision or fragmentation energy in accordance with the invention.

At 602 one or more precursor ions is selected, in order to obtain desired fragmentation or daughter ions. For example, in order to conduct a desired analysis a user of a mass spectrometer 10, 10' shown in FIGS. 1 and 2 can use an appropriately-configured user interface to provide to the controller 160 command and/or data signals adapted to cause desired MS/MS scan conditions to be set within the mass spectrometer 10, 10', and to cause a sample containing suitable substances to be ionized, and the desired precursor ion(s) to be injected into the collision cell Q2 (32). For example, the quadrupole set Q1 can be configured, using appropriate combinations of gas pressures and RF/DC voltages provided via power supply 36, to inject only desired precursor ion(s) into the collision cell Q2 (32) at a desired initial or starting CE.

At 604, collision cell Q2 (32) can be configured to transmit all ion fragments within a given m/z range, as for example having m/z ranges equal to or less than a desired value, into the mass analyzer 130, 35. For example, a suitably-configured user interface can be adapted to provide to the controller 160 signals interpretable by the controller for causing the collision cell Q2 (32) to eject fragmentation ions within one or more selected ranges. In many analyses of the type for which such methods are currently well adapted, the collision cell Q2 (32) can be configured to eject fragment ions having two or more specific m/z values. For example, by causing a suitably-configured voltage ramp or other electromagnetic pulse to be pushed through the collision cell q2 (32), ions of one or more desired portions of the m/z spectrum can be ejected into the mass analyzer 35, 130. A wide number of techniques suitable for use in ejecting ions from collision cells in accordance with the invention are now known, and doubtless others will hereafter be developed.

At 606 the periods for transmission windows from the collision cell Q2 (32) is set. In many analyses it can be advantageous to set the transmission windows on the shortest and most rapidly-repeated cycles possible, consistent with the purposes of the analysis and the sensitivity of the mass spectrometer instrument 10, 10'. This can, for example, enable the assessment of a resultant m/z spectrum in a statically meaningful way in the shortest possible period of time. For example, using equipment of the type described herein under current laboratory operating conditions, spectra are acquired every 100 ms, and are summed as described herein until a user-specified accumulation time has been achieved or any other user-determined or desirable end-scan condition has occurred.

At 608 a starting or initial collision energy (CE) is set within the collision cell Q2 (32). As described herein, the initial CE can be set according to any suitable criteria, including for example prior experience and/or a best educated guess. A fixed value may be established for a given instrument configuration, or a value based on the charge and m/z of the desired precursor ion(s) to be analyzed may be used, or estimated using compound structure techniques.

At 610 the scan cycle is initiated. Ions are provided from the ion source 12 and processed according, for example, to the procedures described above.

At 612 data provided through detection of ions provided from collision chamber Q2 (32) is processed, preferably in real time (i.e., with the minimum possible delay). Data representing total counts (i.e., ion currents) from all desired precursor and daughter ions can be stored for further processing. Storage may be provided using any suitable volatile or persistent memories accessible to and preferably controllable by the controller 160, such as for example random access or FLASH memories, disc storage, etc.

When a desired amount of data representing ion counts (i.e., ion currents) has been collected, at 614 the ratio of the precursor ion current to the daughter ion current can be calculated.

At 616 a determination is made of the ratio of the precursor ion current to the daughter ion current. Depending upon the determined ratio and the objects of the analysis, a number of various actions may be taken. For example, if the ratio is within a previously-determined desired range, indicating that the fragmentation process is proceeding at a desired efficiency, at 618 the process 600 can be stopped, and further steps in a desired analysis, if any, may be taken.

If the ratio falls outside the desired range, then at 620 a determination can be made of the total ion counts detected in the spectrum. Depending upon the determined ion count and the objects of the analysis, a number of various actions may be taken. For example, if the total ion count is below a desired threshold, at 622 a flag may be set to in order to cause deferment of any decision to reset the CE to a new level until the desired threshold level has been reached, and processing can return to a previous point in the process, as for example step or stage 610.

If it has been determined at 620 that a desired threshold level of ions has been counted and it has been determined at 616 that the ion current ratio falls outside the desired range, then at 624 the configuration of the mass spectrometer system 10, 10', including for example the CE applied by the collision cell Q2 (32) can be adjusted.

An example of an ion current range suitable for use in determining at 616, 620 whether to reset the CE or otherwise reconfigure the mass spectrometer 10, 10' is a range of 0.01 to 0.25. This range has been used with satisfactory results by the inventors.

An example of an empirically-derived formula useful for determining a change in the CE applied within a collision cell Q2 (32) in performing analyses in accordance with the invention is:

$$\text{Change in } CE = 4.5 * ln(\text{Ratio}) + 13.5$$

Where CE is measured in electron volts (eV). This formula has been found by the inventors to provide good results in a variety of circumstances.

As a part of re-configuring the mass spectrometer Q2 (32) at 624, data representing the circumstances, e.g., time, point in analysis, etc., in which the new CE was set can be stored for future processing and reference, preferably in memory accessible to and controllable by the controller 160. In addition, memory buffers tracking the total precursor signal and the total fragments signal may be changed or reset.

Process 610-624 can be repeated until a desired amount of data has been collected, as for example in order to develop a desired level of clarity in an output m/z spectrum, or until a desired window of data has been recorded.

While the invention has been described and illustrated in connection with preferred embodiments, many variations and modifications, as will be evident to those skilled in the relevant arts, may be made without departing from the spirit and scope of the invention; and the invention is thus not to be limited to the precise details of methodology or construction set forth above as such variations and modifications are intended to be included within the scope of the invention. Except to the extent necessary or inherent in the processes themselves, no particular order to steps or stages of methods or processes described in this disclosure, including the Figures, is implied. In many cases the order of process steps may be varied without changing the purpose, effect, or import of the methods described.

What is claimed is:

1. A method of controlling the fragmentation of ions during mass spectral analysis, comprising:

(i) at a starting collision energy provided within a mass spectrometer, fragmenting at least one of a plurality of precursor ions generated from a sample to produce a plurality of daughter ion fragments;

(ii) determining an ion current associated with unfragmented precursor ions in the mass spectrometer;

(iii) determining an ion current associated with the daughter ion fragments in the mass spectrometer;

(iv) determining the ratio of the current associated with the unfragmented precursor ions to the current associated with the daughter ion fragments; and (v) adjusting the collision energy provided in the mass spectrometer at (i) to move the ratio toward a predetermined range or value.

2. The method of claim 1, further comprising repeating (i)-(v), as necessary, to bring the ratio into the predetermined range.

3. The method according to claim 1, wherein the collision energy is adjusted by an amount determined using the relation:

$$\Delta CE = m * \ln(\text{ion current ratio}) + B,$$

where ΔCE is the change by which the collision energy is adjusted; and m and B are constants derived through at least one of theoretical analysis and experimentation.

4. The method according to claim 3, wherein the collision energy is adjusted by an amount determined using the relation:

$$\Delta CE = 4.5 * \ln(\text{ion current ratio}) + 13.5 \text{ (eV)}.$$

5. A system useful for controlling the fragmentation of ions during mass spectral analysis, the system comprising a controller adapted to:

(i) at a starting collision energy provided within a mass spectrometer, fragment at least one of a plurality of precursor ions generated from a sample to produce a plurality of daughter ion fragments;

(ii) determine an ion current associated with unfragmented precursor ions in the mass spectrometer;

(iii) determine an ion current associated with the daughter ion fragments in the mass spectrometer;

(iv) determine the ratio of the current associated with the unfragmented precursor ions to the current associated with the daughter ion fragments; and (v) adjust the collision energy provided in the mass spectrometer at (i) to move the ratio toward a predetermined range or value.

6. The system of claim 5, wherein the controller is adapted to repeat (i)-(v), as necessary, to bring the ratio into the predetermined range.

7. The system of claim 5, wherein the collision energy is adjusted by an amount determined using the relation:

$$\Delta CE = m * \ln(\text{ion current ratio}) + B,$$

where ΔCE is the change by which the collision energy is adjusted; and m and B are constants derived through at least one of theoretical analysis and experimentation.

8. The system of claim 7, wherein the collision energy is adjusted by an amount determined using the relation:

$$\Delta CE = 4.5 * \ln(\text{ion current ratio}) + 13.5 \text{ (eV)}.$$

9. A computer usable medium having computer readable code embodied therein for causing a mass spectrometer to:

(i) at a starting collision energy provided within a mass spectrometer, fragment at least one of a plurality of precursor ions generated from a sample to produce a plurality of daughter ion fragments;

(ii) determine an ion current associated with unfragmented precursor ions in the mass spectrometer;

(iii) determine an ion current associated with the daughter ion fragments in the mass spectrometer;

(iv) determine the ratio of the current associated with the unfragmented precursor ions to the current associated with the daughter ion fragments; and (v) adjust the collision energy provided in the mass spectrometer at (i) to move the ratio toward a predetermined range or value.

10. The medium of claim 9, comprising code adapted for causing the mass spectrometer to repeat (i)-(v), as necessary, to bring the ratio into the predetermined range.

11. The medium of claim 9, wherein the collision energy is adjusted by an amount determined using the relation:

$$\Delta CE = m * \ln(\text{ion current ratio}) + B,$$

where ΔCE is the change by which the collision energy is adjusted; and m and B are constants derived through at least one of theoretical analysis and experimentation.

12. The medium of claim 11, wherein the collision energy is adjusted by an amount determined using the relation:

$$\Delta CE = 4.5 * \ln(\text{ion current ratio}) + 13.5\ (\text{eV}).$$

* * * * *